US006086522A

United States Patent [19]

Hechler

[11] Patent Number: 6,086,522

[45] Date of Patent: Jul. 11, 2000

[54] BUCKLE-PLATE FOLDING STATION AND METHOD OF CONTROLLING SAME

[75] Inventor: Hatto Hechler, Stuttgart, Germany

[73] Assignee: Stahl Gmbh & Co. Maschinenfabrik, Ludwigsburg, Germany

[21] Appl. No.: 09/182,255

[22] Filed: Oct. 29, 1998

[30] Foreign Application Priority Data

Oct. 30, 1997 [DE] Germany ..... 197 47 997

[51] Int. Cl.[7] ..... B31B 1/00; B31F 1/00

[52] U.S. Cl. ..... 493/23; 493/420; 493/18; 493/34

[58] Field of Search ..... 493/420, 421, 493/419, 23, 17, 18, 30, 34

[56] References Cited

U.S. PATENT DOCUMENTS

| | | | |
|---|---|---|---|
| 4,701,155 | 10/1987 | Ott | 493/23 |
| 5,026,035 | 6/1991 | Martinez Sanz et al. | 493/27 |
| 5,125,633 | 6/1992 | Fecker et al. | 493/421 |
| 5,242,364 | 9/1993 | Lehmann | 493/18 |
| 5,246,415 | 9/1993 | Fuss | 493/420 |
| 5,683,338 | 11/1997 | Krasuski et al. | 493/420 |
| 5,871,433 | 2/1999 | Lehmann et al. | 493/420 |

FOREIGN PATENT DOCUMENTS

| | | |
|---|---|---|
| 511488A1 | 3/1992 | European Pat. Off. . |
| 732293A2 | 9/1996 | European Pat. Off. . |
| 2738689C3 | 8/1977 | Germany . |
| 9006855 U1 | 8/1990 | Germany . |
| 19515749A1 | 4/1995 | Germany . |

*Primary Examiner*—John Sipos
*Assistant Examiner*—Steven Jensen
*Attorney, Agent, or Firm*—Frost & Jacobs LLP

[57] ABSTRACT

Provided by the invention is a buckle-plate folding station including a first folding roller and two further contra-rotating fold-forming rollers and an adjustable buckle-plate folding unit. The intention of the invention is to provide a buckle-plate folding station enabling the point in time of fold formation to be determined. For this purpose means for detecting sheet infeed are provided in the buckle-plate folding station. The buckle-plate folding station further comprises means for detecting the deflection of at least one of the fold-forming rollers in forming the fold. Means for determining the sheet length fed between sheet infeed and formation of the fold are also provided.

17 Claims, 5 Drawing Sheets

BUCKLE-PLATE FOLDING STATION AND METHOD OF CONTROLLING SAME

Figure 1:
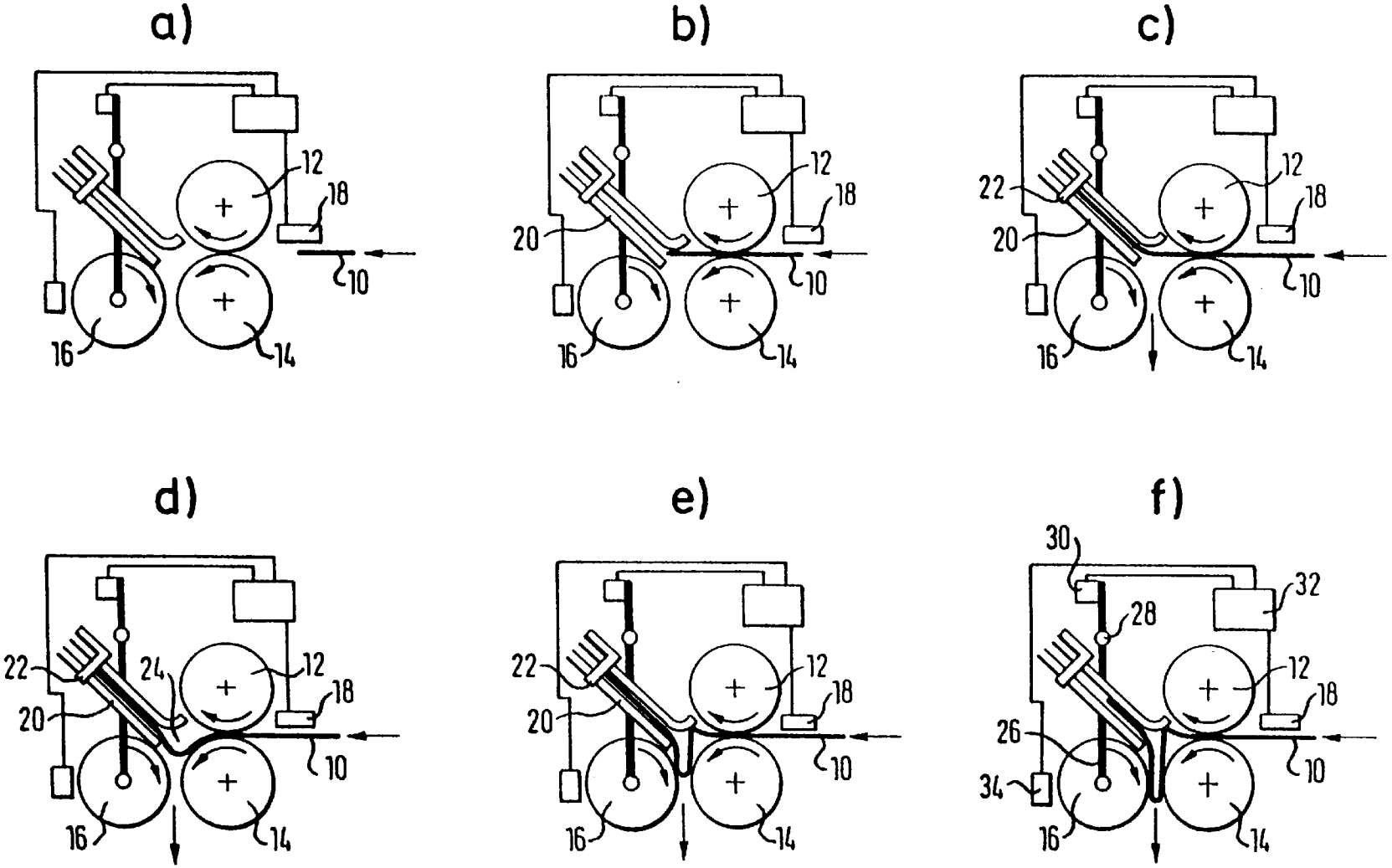

The present invention relates to a buckle-plate folding station including a first folding roller, a pair of counter-rotating fold-forming rollers and an adjustable buckle-plate folding unit. The invention relates furthermore to a method of adjusting a buckle-plate folding station and, in particular, the register thereof.

Buckle-plate folding stations are known from prior art. Three folding rollers, substantially arranged at the corner points of a right triangle, and a buckle-plate folding unit form a buckle-plate folding station. The two first folding rollers arranged vertically one above the other feed the incoming sheet into the buckle-plate folding unit up to its stop which is adjustable as required. The sheet is fed into the buckle-plate folding unit at a running speed adapted to the surface quality of the paper concerned. When the leading edge of the sheet comes up against the stop and with simultaneous further transport of the sheet, a sagging buckle forms between the three folding rollers in the buckle-forming space inbetween, this buckle being nipped by the two contra-rotating folding rollers arranged horizontally juxtaposed. In passing through the rollers the sheet thus forms the fold. In a buckle-plate folding station the folding process is done on the fly, i.e. without being dictated by a timing sequence, as a result of which high folding capacities are achievable. In a buckle-plate folding machine several buckle-plate folding stations may be provided. The gap between the folding rollers needs to be set in accordance with the sheet thickness passing therethrough. This is done by mounting the folding rollers on a two-armed lever, the end of which opposite the folding roller is urged by a setscrew. The stop of the buckle-plate folding unit too, as well as the width of the buckle-plate unit folding unit and the position of the entrance and fillets of the buckle-plate unit relative to the buckle-forming space need to be set in accordance with the quality of paper used and sheet size. In addition, these settings also need to be made with changes in humidity, since this alters the stiffness of the paper. Changes in production speed too, result in a changed deformation of the sheet in the buckle-plate folding unit or in the buckle-forming space so that the location of the crease is shifted on the sheet, thus requiring the setting of the buckle-plate folding station to be corrected, where necessary. In this arrangement the displacement of the crease on the sheet may not be found out until folding of the sheet has been finished. Hitherto there has been no way of determining the point in time of forming the fold and thus of detecting displacements in the location of the crease on the sheet on the fly in production.

Even if such a displacement in the crease location was detected, the necessary settings would have to be done manually.

It is thus the object of the invention to provide a buckle-plate folding station which makes it possible to determine the point in time of forming the fold. A further object of the invention is to provide a buckle-plate folding station permitting closed-loop control of the location of the crease on the sheet. A still further object of the invention is to provide a method of controlling the register of a buckle-plate folding station ensuring a constant location of the crease on the sheet despite a change in production speed or paper stiffness.

In accordance with the invention a buckle-plate folding station is provided for this purpose which includes a first folding roller, a pair of contra-rotating fold-forming rollers and an adjustable buckle-plate folding unit. The buckle-plate folding station comprises means for detecting a moment of sheet infeed, means for detecting a moment of deflection of at least one of the fold-forming rollers in forming the fold and means for detecting a length of sheet fed between these moments of sheet infeed and deflection.

By detecting sheet infeed a reference point in time is defined permitting target values to be established. Forming the fold is done precisely as of the point in time at which the sagging buckle is nipped by the two folding rollers. For forming the fold the fold-forming rollers exert pressure on the buckle, as a result of which the folding rollers are slightly deflected. Sensing this deflection of at least one of the fold-forming rollers thus enables the point in time of forming the fold to be precisely determined even in the case of multiple creases. Since the sheet length fed between sheet infeed and forming the fold is determined, a target value is available which characterizes a satisfactory formation of the fold. The deflection of the fold-forming rollers may be sensed by methods which directly measure the movement, e.g. travel, speed or acceleration, or by methods which measure the reactions triggered by the movement, e.g. by measuring the force or deformation of components exposed to this force.

In one aspect of the invention it is provided for that the means for detecting the deflection of the folding rollers on at least one bearing lever of the folding rollers comprise a strain-gauge arrangement. The elastic deformation of the bearing lever and the reaction forces in deflection of the folding roller may thus be directly sensed electrically without moving parts, and thus further processed by simple ways and means.

In another aspect of the invention it is provided for that the means for detecting the folding roller deflection comprise at least one piezoelectric sensor arranged on one bearing lever of the folding roller. By means of piezoelectric sensors it is possible, for example, to detect the acceleration or by further processing the measurement signals to also detect the bearing lever travel of the folding roller.

In an advantageous aspect of the invention it is provided for that the means for detecting the folding roller deflection comprise at least one optical sensor. In this arrangement, detecting the deflection of the folding roller may be done, for example, via a light barrier or also via the reflection of a light beam at the bearing lever.

In yet a further aspect of the invention it is provided for that the means for detecting the sheet infeed comprise at least one optical sensor, an optical sensor permitting reliable and precise detection of the sheet infeed by simple ways and means, for example, by detecting the change in reflection or transmission on sheet infeod.

It is provided for furthermore that the means for determining the sheet length fed between sheet infeed and formation of the fold comprise a pulse generator assigned to a folding roller and a counting device. Since the circumference of the folding roller is known the number of pulses output by the pulse generator enables the travel from a point on the circumference of the folding roller and thus the sheet length fed to be determined. Since in general all three folding rollers of the buckle-plate folding station rotate at the same peripheral velocity, the pulse generator may be arranged at any of the folding rollers or also at the drive train of the buckle-plate folding station. Magneto-inductive, optical or also Hall-effect sensors are suitable as pulse generators. A commercially available discrete electric or also an integrated circuit may be used as the counting device.

In accordance with one advantageous aspect of the invention optical sensors are also provided for detecting the leading edge of the printed image on an incoming sheet. This embodiment of the invention is especially of advantage when, for example, a brochure or a pamphlet is to be produced on which the printed image shifts or fluctuates relative to the leading edge of the sheet. The crease in such sheets needs to be placed precisely relative to the printed image since otherwise when fluctuations occur between sheet and printed image leading edges the margin could be cut off. Sensing the printed image leading edge is possible by simple ways and means employing an optical sensor sensing the transmission or reflection of the sheet.

In still a further aspect of the invention it is provided for that the adjustable buckle-plate folding unit comprises at least one electrically driven actuator and a closed-loop control unit is provided which processes the signals of the means for detecting the sheet infeed, the signals of the means for detecting the deflection of at least one of the folding rollers in forming the fold and the signals of the means for determining the sheet length fed between sheet infeed and forming the fold and which provides input control of the electrically driven actuator of the buckle-plate folding unit. These measures make it possible, in addition to indicating any displacement in the location of the crease on the sheet, to automatically compensate such a displacement. By signalling the electrically driven actuator of the buckle-plate folding unit the length of the sheet section shifted into the buckle-plate folding unit during formation of the buckle may be influenced, as a result of which any change in the deformation of the sheet during formation of the buckle, for example, due to a higher production speed or a change in paper stiffness, may be compensated. In this arrangement servomotors or stepper motors provided with a potentiometer may be provided as the actuator.

It is furthermore of advantage when the closed-loop control unit also processes the signal of the sensor for detecting the leading edge of the printed image, ensuring precise positioning of the crease by including the signal of the printed image sensor in processing also in case the location of the printed image on a sheet changes, thus eliminating the risk of reject finished products.

In yet another further aspect of the invention it is provided for that the electrically driven actuator changes the position of the stop of the buckle-plate folding unit. By changing the position of the stop of the buckle-plate folding unit the sheet length insertable into the buckle-plate folding unit is altered, as a result of which any change in the deformation of the sheet in the buckle-forming space or in the buckle-plate folding unit may be compensated. It is likewise possible to set the stop of the buckle-plate folding unit obliquely to the infeed direction of the sheet entering the buckle-plate folding unit, thus enabling, for example, an image printed skew on the sheet to be compensated.

It is provided for furthermore that an electrically driven actuator adjusts the width of the buckle-plate folding unit, which may be necessary at an increased production speed to avoid corrugations of the sheet in the buckle-plate folding unit.

It is likewise provided for that an electrically driven actuator adjusts at least one buckle-plate fillet. Adjusting the buckle-plate fillet may be of advantage when influencing the formation of the buckle in the buckle-forming space is necessary.

In yet a further aspect it is provided for that an electrically driven actuator shifts the entrance of the buckle-plate folding unit for changing the buckle-forming space. Should, for example, the stiffness of a paper sheet become less due to increasing humidity, the buckle-forming space must be made smaller to ensure a satisfactory formation of the buckle and thus a correct position of the crease on the sheet.

In conclusion it is particularly of advantage when the closed-loop control unit comprises a microprocessor with which complex control procedures may be implemented with a wealth of parameters, the control algorithms also being able to be simply changed by reprogramming the microprocessor. In addition, automatically detecting the target values and adapting them, where necessary, during production may be achieved within the scope of a smart microprocessor.

In accordance with the invention a method of controlling the register of a buckle-plate folding station is provided by which in a learning phase a target value for the sheet length fed between sheet infeed and formation of the fold is defined. During production a current value an established between the sheet infeed and formation of the fold for the fed sheet length is adjusted for zero deviation from the target value by signalling the electrically driven actuator. By means of such a method the production speed of a buckle-plate folding machine may be altered on conclusion of the learning phase without manual adjustment being necessary. Also, any change in paper stiffness, for example, due to changes in humidity, may be compensated by such a method.

It is likewise provided for that in a control for coincidence with the leading edge of the printed image a spacing between a leading sheet edge, and the leading edge of the printed image on the sheet is determined for each incoming sheet. Any fluctuation in the spacing between the leading sheet edge and the leading edge of the printed image, resulting in a displacement in the location of the crease relative to the printed image, is detected by these means and can thus be corrected to zero. This is done preferably by correcting the target value with the thus determined spacing. Such a procedure results in the necessary target value merely being corrected in controlling it for a coincidence with the leading edge of the printed image so that the method steps of control for coincidence with the sheet infeed may be retained, they merely needing to be supplemented by a further correcting step.

Figure 2:
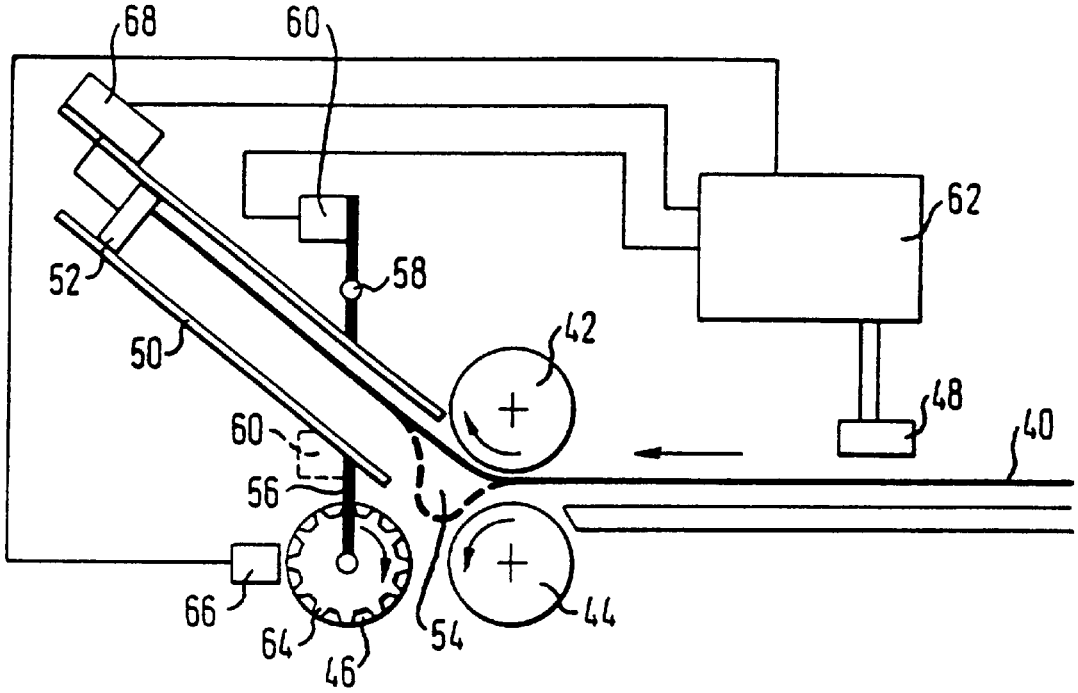
Figure 3:
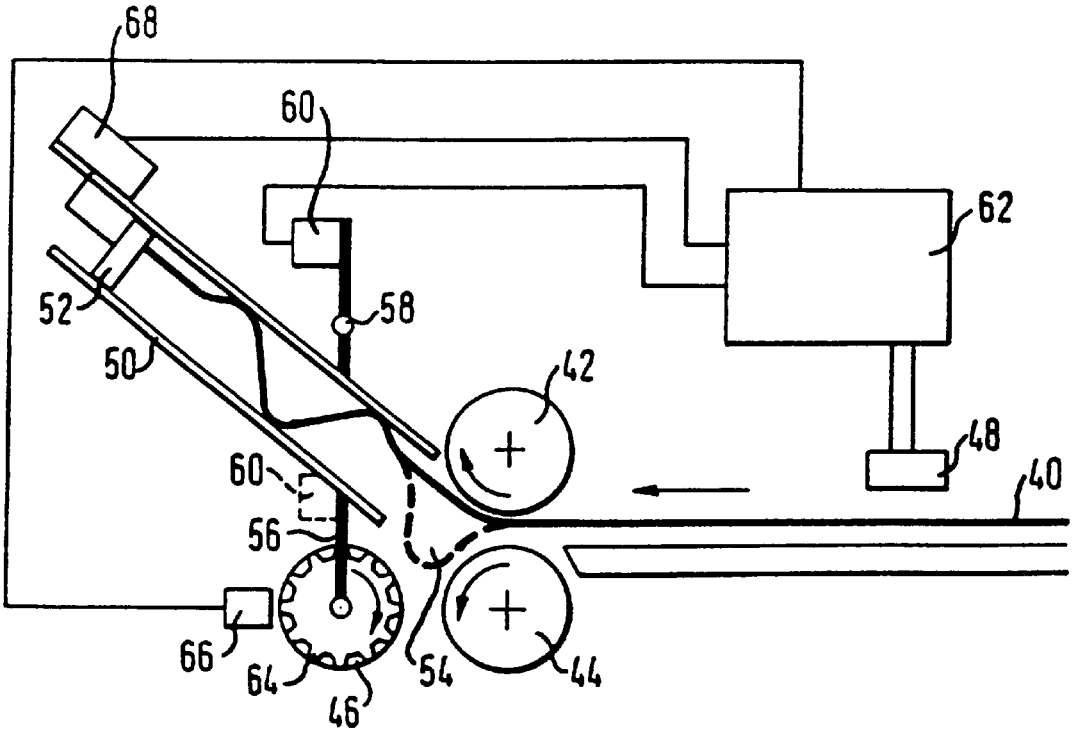
Figure 4:
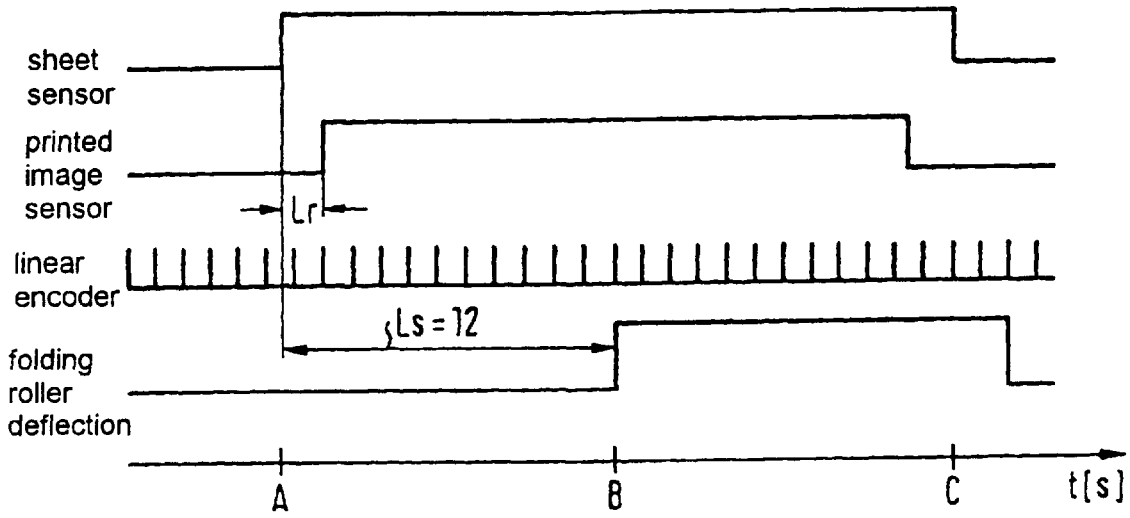
Figure 4:
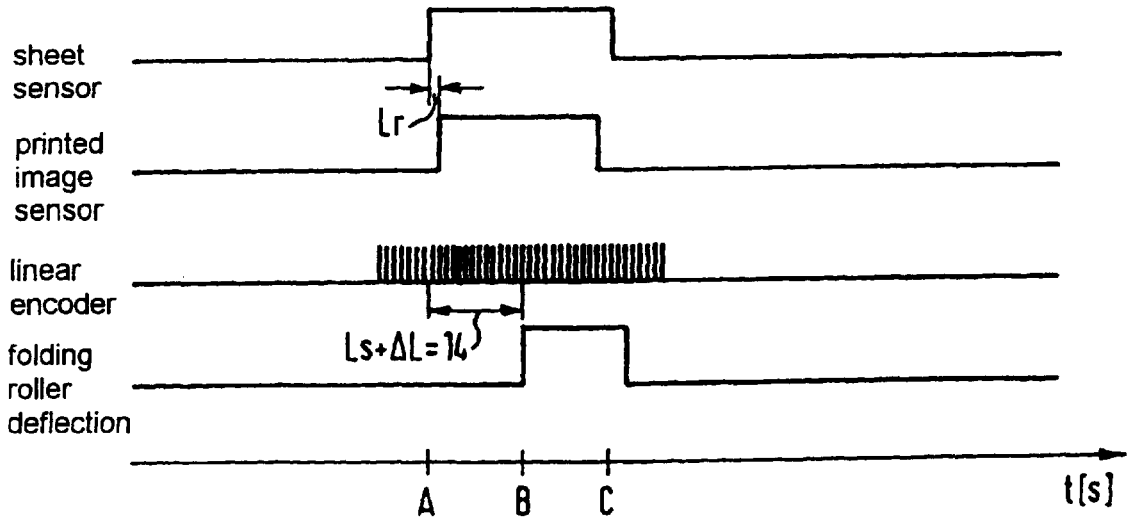
Figure 5:
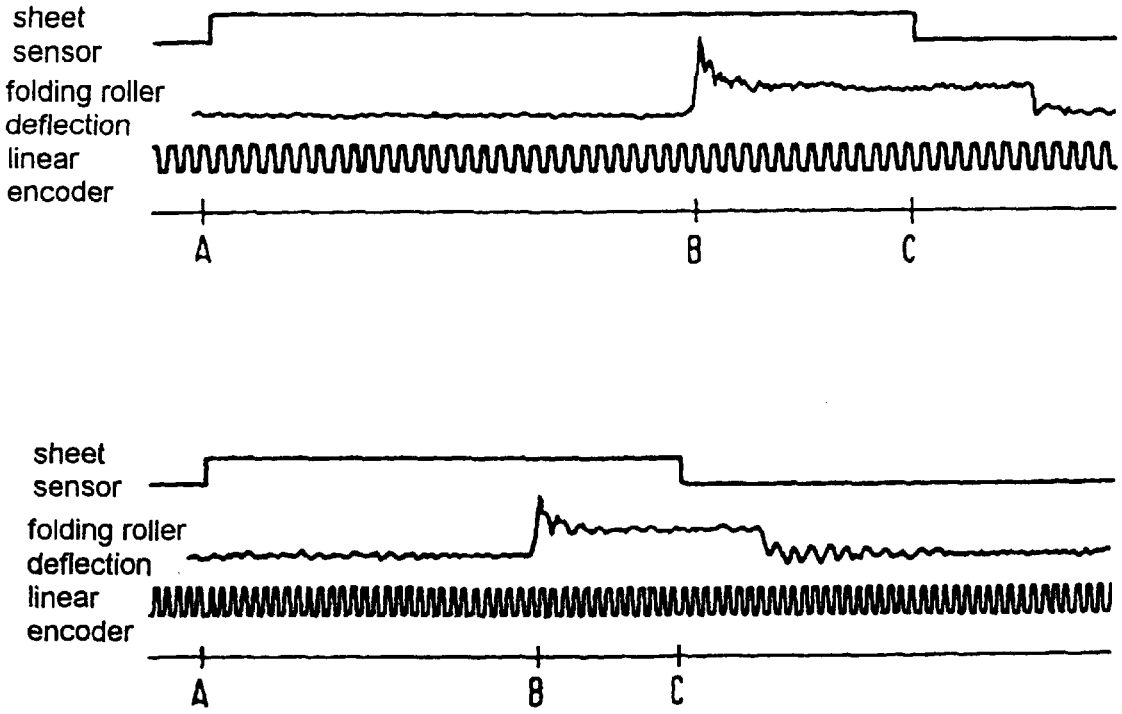
Figure 6:
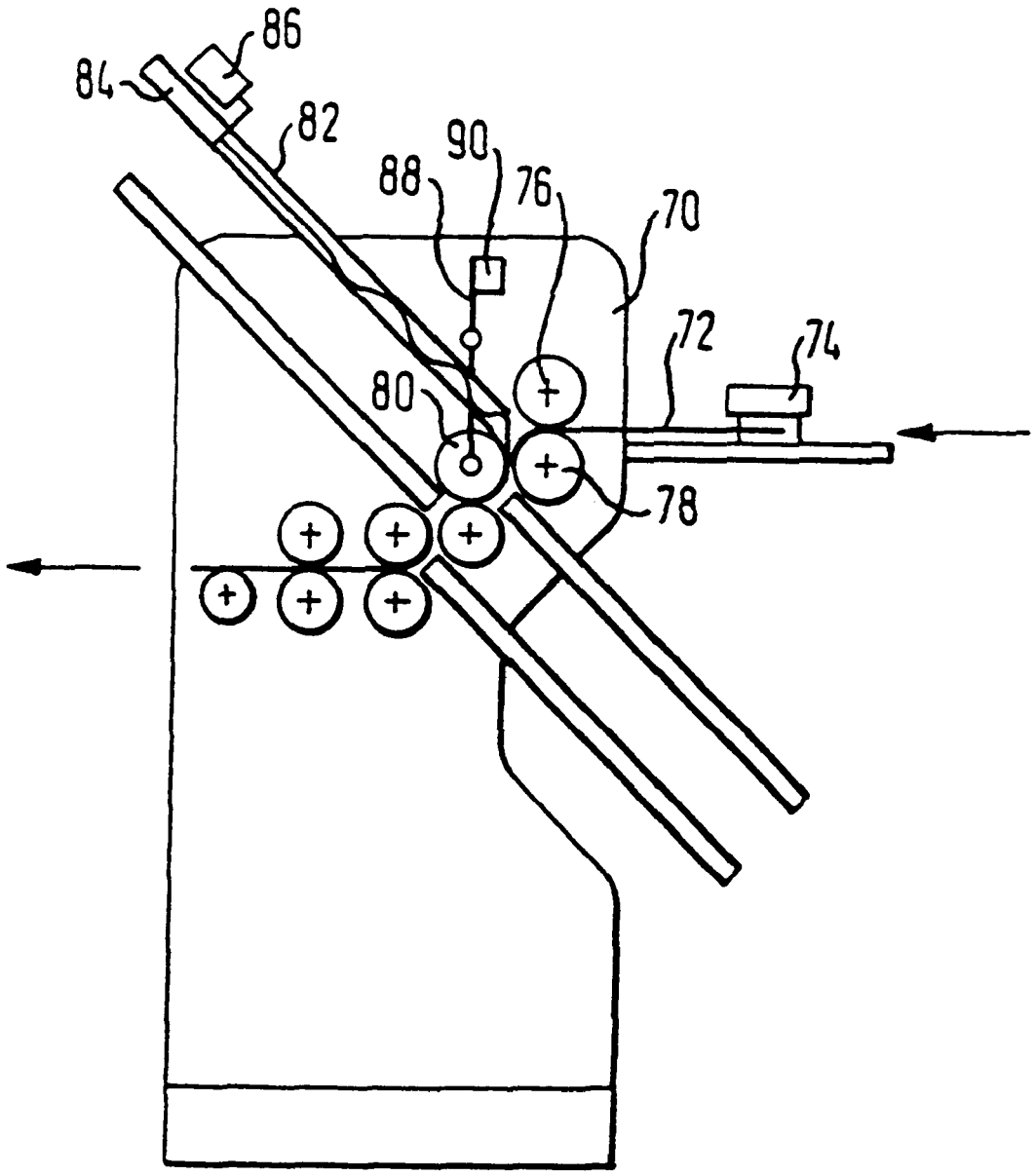

Further features and advantages of the invention read from the following description and from the drawing to which reference is made and in which:

FIGS. 1*a* to 1*f* are schematic illustrations of the various phases in forming the fold in a buckle-plate folding station in accordance with a first embodiment of the invention, FIG. 2 is a schematic illustration of a second embodiment of the invention, FIG. 3 is a schematic illustration of the embodiment as shown in FIG. 2 but for a higher sheet speed or reduced paper stiffness, FIG. 4 are schematic illustrations for timing the sensor signals of the embodiment as shown in FIG. 2 for a lower and a higher speed, FIG. 5 are plots of the sensor signals of the embodiment as shown in FIG. 1 for a lower and a higher speed, and FIG. 6 is a schematic illustration of a buckle-plate folding machine incorporating a buckle-plate folding station in accordance with the invention.

Referring now to FIG. 1*a* there is illustrated a buckle-plate folding station in accordance with the invention for processing a paper sheet 10. A first folding roller 12 is arranged vertically above a second folding roller 14. Arranged horizontally alongside the second folding roller 14 is a further third folding roller 16. All three folding rollers 12, 14 and 16 run at the same peripheral velocity. For the infeed of the sheet 10 or for passing it on in the folded condition, each of the folding rollers 12 and 14 or 14 and 16 counter-rotating. FIG. 1*a* illustrates the point in time of sheet infeed at which the sheet 10, transported by a conventional conveying means, for example, an inclined rollerlbelt table, passes the optical sensor 18 for detecting the sheet infeed.

As evident from FIG. 1*b* the sheet 10 is then nipped by the folding rollers 12 and 14 and fed by its leading edge into the buckle-plate folding unit 20.

It is evident from FIG. 1*c* that the two folding rollers 12 and 14 feed the sheet 10 to be folded up to the stop 22 of the buckle-plate folding unit 20. Since the sheet 10 is now in contact with the stop 22 of the buckle-plate folding unit by its leading edge it can no longer be infed further into the buckle-plate folding unit 20.

As a result, as evident from FIG. 1*d*, it is buckled within the buckle-forming space 24 defined by the three folding rollers 12, 14 and 16 as well as by the buckle-plate folding unit 20.

The folding rollers 12, 14 and 16 continue to rotate in the meantime so that within the buckle-forming space 24 a buckle is formed which is then nipped by the two contra-rotating folding rollers 14 and 16.

FIG. 1*e* shows how the buckle is drawn in between the two folding rollers 14 and 16.

FIG. 1*f* illustrates the point in time of the fold being formed, after which the sheet is fed downwards out of the buckle-plate folding station. The folding rollers 14 and 16 exert a force on the buckle of the sheet 10, as a result of which the folding rollers 14 and 16 are also deflected. The folding roller 16 is rotatably mounted at one end of a two-armed lever 26 capable of pivoting about a bearing point 28. The lever 26 and thus the folding roller 16 are pretensioned against the folding roller 14 via conventional adjusting and pretensioning devices. Arranged at the end of the two-armed lever 26 opposite the folding roller 16 is a sensor 30 which detects any deflection of the folding roller 16, the sensor 30 thus furnishing a signal to the analyzer unit 32 at the point in time of the fold being formed as shown in FIG. 1*f*. The optical sensor 18 for detecting sheet infeed is likewise connected to the analyzer unit 32. To determine the sheet length fed between sheet infeed and formation of the fold a linear encoder 34 is provided at the folding roller 16 which furnishes pulses to the analyzer unit 32 as a function of the rotation of the folding roller 16. The analyzer unit 32 comprises a counting device which counts the pulses output by the linear encoder 34. The counting device of the analyzer unit 32 is activated by the signal of the sensor 18 output in passage of the sheet 10 and is halted by the signal of the sensor 30 output at the point in time of fold formation. In this way the number of pulses counted between sheet infeed and formation of the fold is available in the analyzer unit 32. The number of pulses may be converted by the analyzer unit 32 also into length units of the sheet length fed. Likewise provided in the analyzer unit 32 is a display device which indicates the sheet length fed between sheet infeed and formation of the fold in each folding action. In this way any deviation from a target value corresponding to a satisfactory formation of the fold may be instantly detected without the location of the crease on the finished folded sheet needing to be gauged.

Referring now to FIG. 2 there is illustrated schematically a second embodiment of the buckle-plate folding station in accordance with the invention. In this case, a sheet 40 is likewise led through three folding rollers 42, 44 and 46 and folded. For sensing the point in time of sheet infeed an optical sensor 48 is provided. The optical sensor 48 senses, however, not only the point in time of sheet infeed but could also be capable of sensing the leading edge of the printed image on the sheet, it outputting a signal both on passage of the leading edge of the printed sheet 40 and when the printed image on the sheet 40 has reached a position under the sensor 48. In the condition as shown in FIG. 2 the sheet 40 to be folded has already been fed fully into the buckle-plate folding unit 50 and is in contact with the stop 52 of the buckle-plate folding unit. Within the buckle-forming space 54 a buckle in the sheet 40 is indicated by the broken lines, this buckle materializing in the same way as in the embodiment as shown in FIG. 1*a* to FIG. 1*f*. The folding roller 46 is rotatably mounted on a two-armed lever 56 pivotable about a bearing point 58 and pretensioned against the folding roller 44. Any deflection of the folding roller 46 in forming the fold is sensed by a sensor 60 which furnishes this signal to a closed-loop control unit 62. The sensor 60 may be arranged both above and below the bearing point 58. The position of the sensor 60 indicated by the broken line below the bearing point 58 is particularly of advantage when using a strain-gauge arrangement. The folding roller 46 is provided with a toothed wheel 64 located opposite a magnetic inductive sensor 66. on rotation of the folding roller 46 the magnetic inductive sensor 66 thus furnishes pulses, each of which corresponds to an incremental rotation of the folding roller 46. All three folding rollers 42, 44 and 46 feature the same peripheral velocity so that the sheet length fed may be measured at any of the folding rollers 42, 44 or 46. The magnetic inductive sensor 66 is likewise electrically connected to the closed-loop control unit 62. Accordingly, as evident from FIG. 2, the input signals available in the closed-loop control unit 62 are the signals of the sensor 48 on sensing sheet infeed and the leading edge of the printed image, the signal of the sensor 60 from the fold being formed as well as the incremental signal of the magnetic inductive sensor 66. The closed-loop control unit 62 signals an electrically driven actuator, such as a servomotor 68, which shifts the stop 52 of the buckle-plate folding unit. FIG. 2 shows an operating condition of the buckle-plate folding station operating at low sheet speed. In this operating condition a target value of the sheet length fed between sheet infeed or leading edge of the printed image and forming the fold is defined. This learning phase is implemented at low speed prior to actual commencement of production.

Referring now to FIG. 3 there is illustrated the buckle-plate folding station as shown in FIG. 2 for a higher sheet speed. Due to the fact that the sheet 40 is now fed by the folding rollers 42 and 44 into the buckle-plate folding unit 50 and contacts the stop 52 of the buckle-plate folding unit at a higher speed, the sheet corrugates within the buckle-plate folding unit 50. The sheet length in the buckle-plate folding unit 50 is thus longer than in the condition as shown in FIG. 2. Accordingly, the buckle is formed on the sheet 40 at another position, as a result of which a displacement in the location of the crease on the sheet materializes. Since, however, prior to fold formation, a longer sheet length is fed, the signal of the sensor 60 occurs not before a longer sheet length has been fed on the basis of the signal of the sensor 48. The closed-loop control unit 62 will thus receive a greater number of pulses from the sensor 66 before the signal of the sensor 60 occurs on forming the fold, i.e. a deviation from the target value defined in the learning phase as shown in FIG. 2 is thus established in the closed-loop control unit 62. In response, the closed-loop control unit 62 signals an electrically driven actuator, such as the servomotor 68, and prompts it to displace the stop 52 of the buckle-plate folding unit in the direction of the buckle-forming space 54. The sheet length which may be shifted into the buckle-plate folding unit is thus reduced so that the crease of the next sheet 40 is again located in the correct position on the sheet.

Referring now to FIG. 4 there is illustrated schematically the timing of the sensor signals of the sensors 48, 60 and 66 as shown in FIGS. 2 and 3. Illustrated in the upper plot of FIG. 4 are the sensor signals at low speed, i.e. in the condition as shown in FIG. 2. At the point in time A the sheet/printed image sensor 48 senses the sheet infeed. After two pulses of the linear encoder 66 the leading edge of the printed image on the sheet is sensed, likewise by sheet/printed image sensor 48, thus defining a correction value Lr as needed in closed-loop control for coincidence with the leading edge of the printed image on a sheet. At the point in time B the fold is formed as established by the signal of the sensor 60 sensing the deflection of the folding roller. Between the sheet infeed A and the fold formation B twelve pulses of the linear encoder 66 exist in this case so that the target value of the sheet length fed between sheet infeed and formation of the fold determined in the learning phase is defined as Ls=12. At the point in time C the sheet fed has finally passed the sensor 48 completely so that the signal thereof returns to a low level.

The lower plot in FIG. 4 corresponds to the timing of the sensor signals in the condition as shown in FIG. 3, at a higher speed. Here again, at the point in tine A the sheet infeed is sensed by the sheet/printed image sensor 48 and at two pulses of the linear encoder 66 later the leading edge of the printed image on the sheet is detected, this corresponding to the correction value Lr. At the higher speed the sheet corrugates in the buckle-plate folding unit an shown in FIG. 3 so that a longer sheet length is fed into the buckle-plate folding unit before the buckle can form. The point in time B, at which the sensor 60 senses formation of the fold, thus occurs later so that between sheet infeed A and formation of the fold B a sheet length Ls+ΔL is fed. In the example as shown in FIG. 4 ΔL amounts to two pulses. To compensate this additionally fed sheet length ΔL, the closed-loop control unit 62 thus needs to signal the servomotor 68 such that it shifts the stop 52 of the buckle-plate folding unit until the number of pulses detected between the sheet infued A and the formation of the fold B again corresponds to the target value Ls.

Referring now to FIG. 5 plots are illustrated, representing the sensor signals of the buckle-plate folding station as shown in FIG. 1. In the upper plot the conditions at low speed are plotted. At the point in time A the sheet sensor 18 senses sheet infeed. At the point in time S the sensor 30 senses the deflection of the folding roller 16 in forming the fold. Likewise plotted is the point in time C at which the sheet 10 has fully passed the sensor 18. The pulses are furnished by the linear encoder 34.

Analogous to FIG. 4 the lower plot as shown in FIG. 5 plots the conditions at the higher speed.

Referring now to FIG. 6 there is illustrated in conclusion the schematic arrangement of a buckle-plate folding machine 70 incorporating a buckle-plate folding station in accordance with the invention. A sheet 72 passes under a sensor 74 for sensing sheet infeed and the leading edge of the printed image and is nipped and folded by the folding rollers 76, 78 and 80. At the end of the buckle-plate folding unit 82 a stop 84 of the buckle-plate folding unit is arranged which is positioned by a servomotor 85. in the same way as already described for the embodiments hitherto the folding roller 80 is rotatably mounted on a two-armed lever 88 at the end of which, opposite the folding roller 80, a sensor go is arranged for sensing the deflection of the folding roller 80 in forming the fold. Following the first buckle-plate folding station defined by the folding rollers 76, 78 and 80 are further buckle-plate folding stations, the folding roller 60 of the first buckle-plate folding station serving at the same time as the first folding roller of a second buckle-plate folding station. For the sake of a clear illustration only one buckle-plate folding station in accordance with the invention is shown in the buckle-plate folding machine 70 as depicted in FIG. 6. It will readily be appreciated, however, that all buckle-plate folding stations provided in the buckle-plate folding machine 70 may be of the type in accordance with the invention.

I claim:

1. A buckle-plate folding station including a first folding roller, a pair of counter-rotating fold-forming rollers and an adjustable buckle-plate folding unit, and further comprising:

a) means for detecting a sheet infeed at said folding unit and determining a corresponding moment in time, b) means for detecting a deflection of at least one of said pair of fold-forming rollers in forming a fold and determining a corresponding moment in time, c) means for determining a length of sheet fed between said determined moments in the between sheet infeed and deflection, and d) means for cantrolling and processing signals provided by said means for detecting said sheet infeed, signals provided by said means for detecting a deflection, and signals provided by said means for determining said fed sheet length to adjust buckle-plate length.

2. The buckle-plate folding station as set forth in claim 1, wherein one of said pair of fold-forming rollers is mounted on at least one bearing lever and said means for detecting said deflection comprises a strain-gauge unit arranged at said bearing lever.

3. The buckle-plate folding station as set forth in claim 1, wherein one of said pair of fold-forming rollers is mounted on at least one bearing lever and said means for detecting said deflection comprises at least one piezoelectric sensor positioned at said bearing lever.

4. The buckle-plate folding station as set forth in claim 1, wherein said means for detecting said deflection comprises at least one optical sensor.

5. The buckle-plate folding station as set forth in claim 1, wherein said means for detecting said sheet infeed comprises at least one optical sensor.

6. The buckle-plate folding station as net forth in claim 1, wherein said means for determining said sheet length fed between said sheet infeed and deflection comprise a pulse generator associated with a folding roller and a pulse counting device.

7. The buckle-plate folding station as set forth in claim 1, wherein at least one optical sensor is provided for detecting a leading edge of a printed image on a passing sheet.

8. The buckle-plate folding station as set forth in claim 1, wherein said adjustable buckle-plate folding unit comprises at least one electrically driven actuator for adjusting buckle-plate folding unit length and a closed-loop control unit which processes signals provided by said means for detecting said sheet infeed, signals provided by said means for detecting a deflection and signals provided by said means for determining said fed sheet length to provide an input control for said electrically driven actuator.

9. The buckle-plate folding station as set forth in claim 7, wherein said closed-loop control unit also processes a signal provided by said sensor for detecting a leading edge of a printed image.

10. The buckle-plate folding station as set forth in claim 8, wherein said electrically driven actuator adjusts a stop in said buckle-plate folding unit.

11. The buckle-plate folding station as set forth in claim 1, wherein an electrically driven actuator is provided for shifting a stop in said buckle-plate folding unit for changing the depth of a buckle-forming space.

12. The-buckle-plate folding station as set forth in claim 8, wherein said closed-loop control unit comprises a microprocessor.

13. The buckle-plate folding station as set forth in claim 8, wherein said closed-loop control unit also processes a signal provided by said sensor for detecting a leading edge of a printed image.

14. A method of controlling a buckle-plate folding station of the type comprising a first folding roller, a pair of counter-rotating fold-forming rollers and an adjustable buckle-plate folding unit, further comprising:

providing a means for detecting a sheet infeed at said folding unit and determining a corresponding moment in time, providing means for detecting a deflection of at least one of said pair of fold-forming rollers in forming a fold and determining a corresponding moment in time, providing means for determining a length of sheet fed between said determined moments in time between sheet infeed and deflection, providing at least one electrically driven actuator for adjusting buckle-plate length on said adjustable buckle-plate folding unit, providing a closed-loop control unit which provides an input control for said electrically driven actuator by processing signals provided by said means for detecting said sheet infeed, signals provided by said means for detecting a deflection and signals provided by said means for determining said fed sheet length, setting an initial target value for said length of sheet fed between said sheet infeed and deflection, and repeatedly measureing said sheet infeed and said deflection, wherein a current value of sheet length fed between said sheet infeed and deflection is determined, any difference between said current value and said target value being eliminated by controlling said electrically driven actuator to adjust buckle-plate folding unit length.

15. The method as set forth in claim 14, wherein a distance between a leading sheet edge and the leading edge of a printed image on the sheet is determined for each sheet arriving at said folding unit and said control unit uses said distance determination when providing input control for said electrically driven actuator.

16. The method as set forth in claim 15, wherein the control unit continuously adjusts said electrically driven actuator as necessary to provide a constant relation between the leading edge of said printed image and the location of a crease formed by said folding unit.

17. The method as set forth in claim 16, wherein said target value is adjusted by using the leading edge of said printed image instead of a leading sheet edge.

* * * * *